US006519978B2

(12) United States Patent
Pernick et al.

(10) Patent No.: US 6,519,978 B2
(45) Date of Patent: Feb. 18, 2003

(54) APPARATUS AND METHOD FOR KNITTING A FABRIC WITH A LAY-IN YARN ON A CIRCULAR KNITTING MACHINE

(75) Inventors: Bruce Pernick, Stamford, CT (US); Philip Renda, Charlotte, NC (US); James A. Renda, Waxhaw, NC (US)

(73) Assignee: Monarch Knitting Machinery Corp., Glendale, NY (US)

( * ) Notice: Subject to any disclaimer, the term of this patent is extended or adjusted under 35 U.S.C. 154(b) by 0 days.

(21) Appl. No.: 10/124,875

(22) Filed: Apr. 18, 2002

(65) Prior Publication Data

US 2002/0166346 A1 Nov. 14, 2002

Related U.S. Application Data

(60) Provisional application No. 60/285,664, filed on Apr. 23, 2001.

(51) Int. Cl.[7] ..... D04B 9/00
(52) U.S. Cl. ..... 66/8
(58) Field of Search ..... 66/8, 9 R, 10, 66/11, 12, 80, 78, 191

(56) References Cited

U.S. PATENT DOCUMENTS

| | | | | |
|---|---|---|---|---|
| 1,989,617 A | | 1/1935 | Horrocks | |
| 2,098,303 A | | 11/1937 | Moses | |
| 4,020,653 A | | 5/1977 | Mishcon et al. | |
| 4,026,126 A | | 5/1977 | Nuber | |
| 4,244,197 A | | 1/1981 | Althammer | |
| 4,794,767 A | | 1/1989 | Lombardi | |
| 4,819,456 A | | 4/1989 | Guell | |
| 4,920,767 A | | 5/1990 | Plath et al. | |
| 4,926,660 A | * | 5/1990 | Takashi | 66/9 R |
| 4,986,090 A | | 1/1991 | Lombardi | |
| 5,035,124 A | | 7/1991 | Tibbals, Jr. | |
| 5,095,720 A | | 3/1992 | Tibbals, Jr. | |
| 5,109,680 A | * | 5/1992 | Pernick | 66/93 |
| 5,133,196 A | | 7/1992 | Tibbals, Jr. | |
| 5,168,730 A | | 12/1992 | Conti | |
| 5,279,133 A | | 1/1994 | Plath | |
| 5,390,511 A | * | 2/1995 | Shibata et al. | 66/9 R |
| 5,613,375 A | | 3/1997 | Renda et al. | |

FOREIGN PATENT DOCUMENTS

EP 335 618 A1 10/1989

OTHER PUBLICATIONS

*Laying–in in Warp Knitting; Knitting Technology*, D. Spencer, Second Edition 1989, pp. 300–310.

* cited by examiner

*Primary Examiner*—Danny Worrell
(74) *Attorney, Agent, or Firm*—Alston & Bird LLP

(57) ABSTRACT

A circular knitting machine has sinkers arranged for radially reciprocating around an upper portion of a cylinder, and latch needles arranged around the upper portion's perimeter for reciprocating along the axis of the cylinder. Selected ones of the needles draw down a lay-in yarn while the sinkers between the selected needles remain in a pushed forward position, so that the lay-in yarn overrides the nibs of the sinkers. In a preferred embodiment, each forth needle, and only each fourth needle, is selected to draw down a lay-in yarn, and four sinkers are positioned between each adjacent pair of the selected needles so that the lay-in yarn overrides four nibs between each draw down. The selected and non-selected needles engage jersey yarns at other knitting stations. This circular knitting machine can be adapted from existing knitting machines.

17 Claims, 3 Drawing Sheets

APPARATUS AND METHOD FOR KNITTING A FABRIC WITH A LAY-IN YARN ON A CIRCULAR KNITTING MACHINE

CROSS-REFERENCE TO RELATED APPLICATION

The present application claims the benefit of U.S. Provisional Application No. 60/285,664, filed Apr. 23, 2001, and incorporated herein by reference.

FIELD OF THE INVENTION

The present invention relates to circular knitting machines and to methods for knitting fabrics on circular knitting machines. In particular, the present invention relates to coordinating the selective reciprocation of the needles and sinkers to counteract "robbing back" of a lay-in yarn.

BACKGROUND OF THE INVENTION

Circular knitting machines are widely used to produce knitted fabric, such as knitted fabric that is tubular. A conventional circular knitting machine includes a vertically extending cylinder, and multiple sinkers and latch needles that extend around and move relative to the upper end of the cylinder. The sinkers reciprocate radially and the latch needles reciprocate vertically in a cooperative fashion to produce knitted fabric.

Circular knitting machines are used to make many types of fabric, including jersey and fleece fabrics. For example, prior fleece fabrics of the type used in sweatshirts have floating portions of lay-in yarn extending above the "face" of the base fabric structure. Knitted fleece fabrics are usually grouped in the categories of three-end fleeces and two-end fleeces.

It is known to knit three-end fleeces on a circular knitting machine specifically designed to produced this type of fabric. In these machines, two yarns are knitted and one is laid in, and the sinkers are typically double-nosed. The double nosed sinkers are used individually to allow for more lay-in yarn to be measured in. However, these machines are specialized machines that are not readily transformable from standard raceway machines.

In contrast, it is known to knit two-end fleeces on circular knitting machines with standard raceways. Two-end fleeces are typically produced by the use of single-nosed sinkers. In this instance, the length of the lay-in yarn may be measured by drawing the respective needle below the sinker knitting platform, sometimes in combination with the sinker throat pushing the lay-in yarn around the needle shaft. Two-end fleeces formed in this manner are generally used for less expensive sweatshirt-styled fabrics. Whereas it is conventional to use a basic single-knit raceway machine having single throat sinkers to produce fleece fabrics, there is a limitation as to the amount of lay-in yarn that can be introduced. Typically, the amount of land or flat in the stitch cam associated with a lay-in feed is not sufficient to counteract severe robbing back of the amount of lay-in yarn being fed. Likewise, even though lowering the stitch cam on a standard raceway, two-end fleece machine increases the amount of lay-in yarn incorporated into the fabric, it is common for the stitch cam to be lowered as far as possible in an effort to maximize the amount of lay-in yarn incorporated into the fabric. This can jeopardize the quality of the fabric, because unwanted holes in the fabric can be formed by breaking the yarn of the previous stitch not knitted off by the tucking needle. Likewise, the welt cams on the lay-in feeds can also rupture stitches if the welt cams are attached to the same stitch cam post that holds the tuck cam (as is normal), and that post is adjusted for a deep draw for the tuck cam.

In the past, special machines for manufacturing two-end fleece have been built by Vanguard Supreme Knitting Machine Company, a division of Monarch Knitting Machine Corp. These special machines introduce lay-in yarn with a double nosed sinker, and the amount of lay-in yarn is respectively measured by the distance that the upper throats of the sinkers push the lay-in yarn around the needle shanks. However, these machines, like three-end fleece machines, are specialized machines that are not readily transformable from standard raceway knitting machines.

Accordingly, there is a need for methods and apparatus that provide improved countermeasures against robbing back, such as for standard raceway knitting machines, so that high quality fleece fabric can be produced on standard raceway knitting machines.

SUMMARY OF THE INVENTION

In accordance with one aspect, the present invention relates to a method and apparatus for producing a knitted fabric having a lay-in yarn, and more specifically the invention relates to a modification that may be incorporated with minimal added expense into both existing and new raceway-type knitting machines, so that they can produce fabric having the desired lay-in yarn feature.

In accordance with one aspect of the present invention, a circular knitting machine includes multiple needles arranged for reciprocating in the direction of the axis of the machine, and needle cam tracks arranged around the axis for respectively engaging butts of the needles so that one or more intervening needles of the needles are positioned between at least a pair of the needles, with the intervening needle(s) preferably including all of the needles positioned between the pair of needles. During a predetermined period, the pair of needles engage and draw down a lay-in yarn and hold portions of the lay-in yarn in a lower position, and the intervening needle(s) do not draw down the lay-in yarn. Preferably the intervening needle(s) are substantially maintained in a welt position and do not substantially interact with the lay-in yarn during the predetermined period.

The knitting machine also includes multiple sinkers arranged for moving radially relative to the axis, and at least one sinker cam track arranged around the axis for selectively engaging and moving the sinkers. The sinkers are moved so that during the predetermined period, there are one or more intervening sinkers of the sinkers that are positioned between the pair of needles and arranged in a forward position. As a result, the section of the lay-in yarn that spans between the pair of needles is retained over the nib(s) of the intervening sinker(s) positioned between the pair of needles. Preferably the section of the lay-in yarn that spans between the pair of needles is contemporaneously retained over all of the nib(s) of the intervening sinker(s) positioned between the pair of needles. This advantageously counteracts robbing back of the lay-in yarn.

In accordance with one aspect of the present invention, a set of cam tracks for a circular knitting machine is provided, and preferably the cam tracks can be used in standard raceway knitting machines so that these machines can advantageously produce a high quality fleece fabric. In accordance with this aspect, the set includes multiple needle cam tracks that provide the above-described arrangement and operation of the needles, and at least one sinker cam track for moving the sinkers as described above. Preferably each of the cam tracks includes multiple cams that are capable of being removably mounted to the knitting machine.

In accordance with one aspect of the present invention, the multiple needle cam tracks include a first needle cam track for engaging the butts of the pair of needles for controlling the pair of needles during the predetermined period, and a second needle cam track for engaging the butts of the intervening needle(s) for controlling the intervening needle(s) during the predetermined period.

In accordance with one aspect of the present invention, a method of knitting a fleece fabric is provided. In accordance with this aspect, a lay-in yarn and a jersey yarn are introduced into a circular knitting machine. A base fabric structure is formed from the jersey yarn by operating at least some of the needles and sinkers of the machine. In addition, the lay-in yarn is connected to the base fabric structure so that floating portions of the lay-in yarn extend above a face of the base fabric structure. The floats (i.e., floating portions of the lay-in yarn) are formed by operating the above-discussed pair of needles to engage, draw down, and hold portions of the lay-in yarn in a lower position during the predetermined period. At the same time, the above-discussed intervening needle(s) are preferably substantially maintained in a welt position such that the intervening needle(s) do not substantially interact with the lay-in yarn during the predetermined period. In addition, the above-discussed intervening sinker(s) are arranged in a forward position during the predetermined period, so that the section of the lay-in yarn that spans between the pair of needles is retained over the nib(s) of the intervening sinker(s). Preferably the section of the lay-in yarn that spans between the pair of needles is contemporaneously retained over all of the nibs of the intervening sinkers. This advantageously at least partially counteracts robbing back of the lay-in yarn.

BRIEF DESCRIPTION OF THE DRAWINGS

Figure 1:
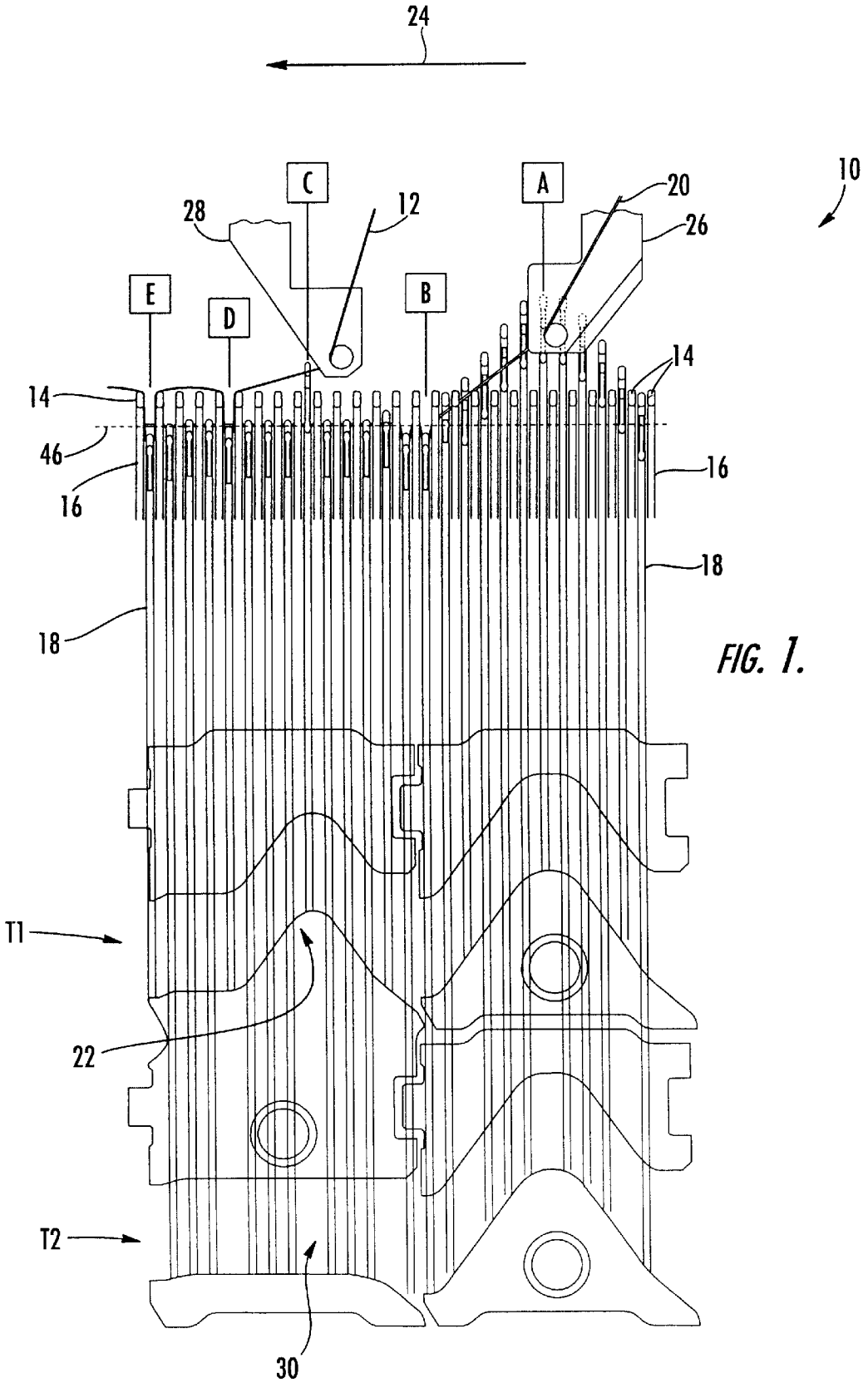
Figure 2:
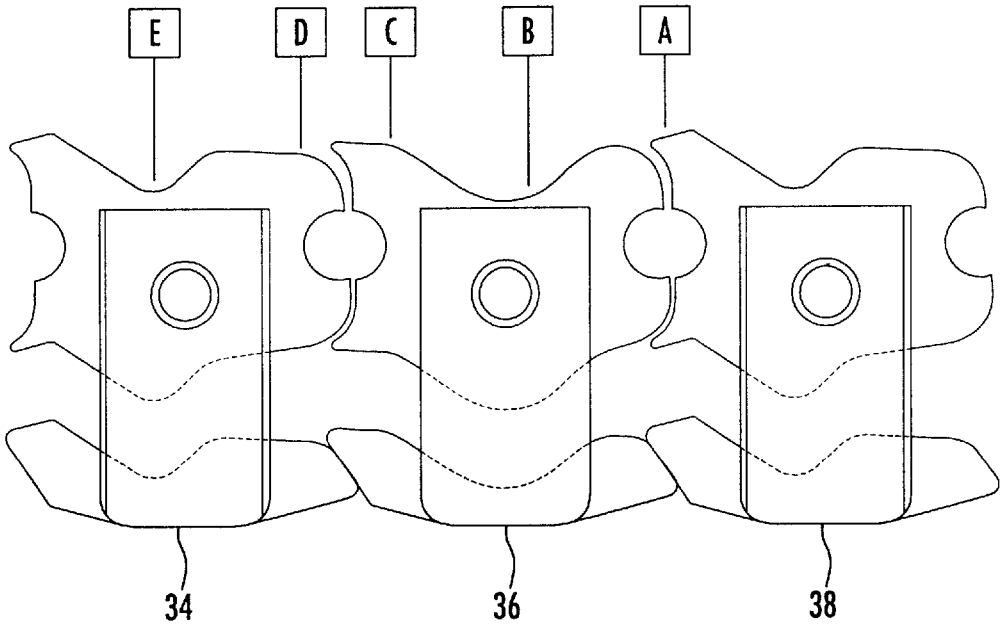

Having thus described the invention in general terms, reference will now be made to the accompanying drawings, which are not necessarily drawn to scale, and wherein:

FIG. 1 diagrammatically illustrates a portion of a circular knitting machine, in accordance with an exemplary embodiment of the present invention;

FIG. 2 illustrates sinker cams of the machine of FIG. 1; and

FIGS. 3A–E are partial views of the machine of FIG. 1 that diagrammatically illustrate the positioning of the sinkers relative to the needles, feeds and yarns during the knitting process, respectively at selected points A–E of FIGS. 1–2, in accordance with the exemplary embodiment of the present invention.

DETAILED DESCRIPTION OF THE INVENTION

The present invention now will be described more fully hereinafter with reference to the accompanying drawings, in which one or some, but not all embodiments are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Generally described primarily with reference to FIG. 1, one aspect of the present invention is the modification of a standard raceway-type knitting machine by altering the needle and sinker camming so as to provide a knitting machine 10 in which a substantial length of lay-in yarn 12 is preferably contemporaneously suspended over the tops of the noses 14 of multiple adjacent sinkers 16 in a manner that counteracts the "robbing back" action of the lay-in yarn as the needles 18 holding the lay-in yarn descend to the knitting position. In the knitting position, the needles 18 holding the lay-in yarn 12 knit it to the base fabric structure, which is knitted from jersey yarn 20. Briefly described in accordance with the exemplary embodiment of the present invention, predetermined needle camming, namely cam 22, is advanced (relative to the sinker camming shown in FIG. 2), and predetermined sinker camming is retarded relative to the needle camming (as compared to the customary relationship), so that the needles 18 that knit in the lay-in yarn 12 are drawn down from a tuck position to the lower stitch draw position while the associated sinkers 16 remain pushed forward. Only a representative few of the needles 18 and sinkers 16 are identified by their reference numerals in FIG. 1, in an effort to clarify the drawing.

More specifically, the knitting machine 10 is provided with two or more needle cam tracks, designated herein as Track 1, Track 2, Track 3, and so on. Only portions of Tracks 1 and 2 are shown in FIG. 1, and they are respectively identified by the reference characters "T1" and "T2" in FIG. 1. Preferably four needle cam tracks are provided in the machine 10, with the tuck cams located on Track 1 and Track 3. FIG. 1 shows that in the exemplary embodiment, and for purposes of illustrating the present invention but without limitation, the needles are arranged so that a sequence of three needles is run in (i.e., have butts that extend into) Track 2, while every fourth needle is run in (i.e., has a butt that extends into) Track 1. Other combinations are contemplated using, for example, sequences with larger or smaller numbers of needles. For illustrative purposes in FIG. 1, the needles that are run in Track 1 do not extend down to Track 2, and the needles that are run in Track 2 do extend to Track 2.

The direction of needle movement through the machine 10 is indicated by an arrow 24 in FIG. 1. In accordance with the exemplary embodiment, all of the needles 18 receive the jersey yarn 20 from feed 26, and then the needles proceed to knit a jersey stitch. Thereafter, the needles 18 that are not to pick up the lay-in yarn 12 at feed 28 go into a welt position on Track 2, due to the interaction between the cam 30 and the butts of the needles that are not to pick up the lay-in yarn. The needles 18 designated to pick up the lay-in yarn 12 are raised to the tuck position by the interaction of their butts and cam 22. Thereafter, the needles 18 designated to pick up the lay-in yarn 12 immediately descend, pulling the lay-in yarn 12 down over the tops of the nibs or noses 14 of the sinkers 16 that are left in an extended forward position by sinker cam 34 (FIG. 2).

A portion of a sinker cam track that includes cams 34, 36 and 38 is shown in FIG. 2. An example of the relative positioning of the cams, sinkers 16, needles 18, and feeds 26 and 28 may be seen by comparing points designated by A, B, C, D and E in FIGS. 1–2 respectively with FIGS. 3A–E. That is, FIGS. 3A–E respectively illustrate the positioning of the sinkers 16 relative to the needles 18, yarns 12 and 20, and feeds 26 and 28 at selected points A–E during the knitting process, with the points A–E being designated in FIGS. 1–2. FIGS. 3A–E also illustrate the relative positions of the sinkers 16 with respect to one another at the points A–E. That is, the needles 18 are in a generally cylindrical arrangement; therefore, the vertical positioning of the needles in FIGS. 3A–E provides a common frame of reference. In FIGS. 3A–E, vertical arrows in close proximity to the needles 18 indicate the direction of movement of the needles. Likewise, horizontal arrows in close proximity to the sinkers 16 in FIGS. 3A–E indicate direction of movement of the sinkers, with a sinker not moving in the radial direction if there is no horizontal arrow closely associated therewith.

Figure 3A:
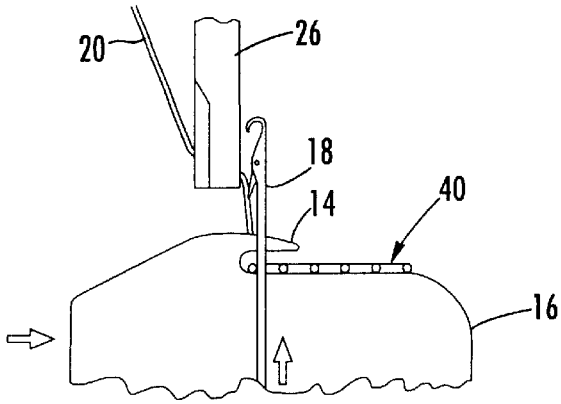
Figure 3B:
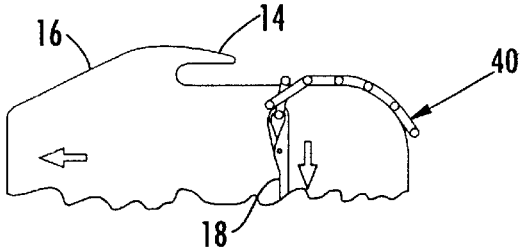
Figure 3C:
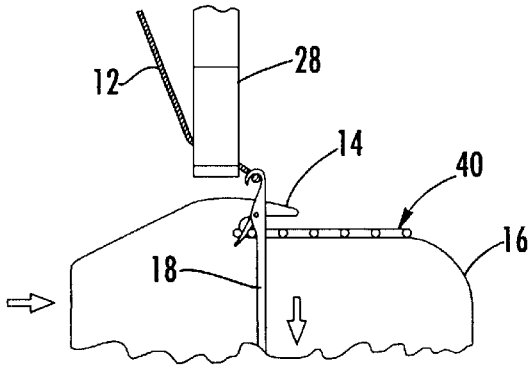
Figure 3D:
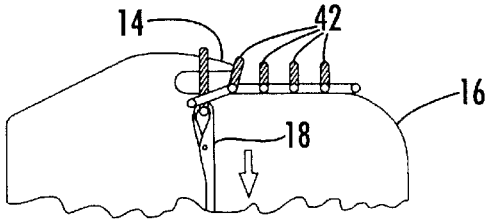
Figure 3E:
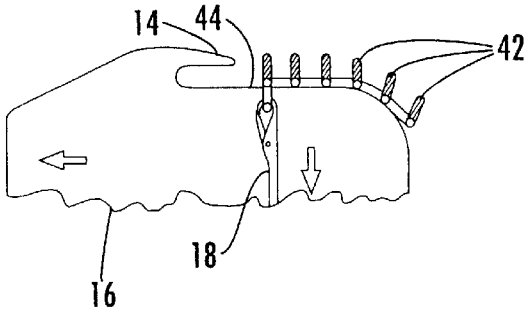

As illustrated in FIGS. 3A and 3B, needles 18 engage and draw down the jersey yarn 20 so as to form knitted loops of a base fabric structure 40. The sinkers 16 retract between points A and B. When the needles 18 reach point C, the sinkers 16 have returned to a forward position and the lay-in yarn 12 is engaged by the needles that are running with butts in Track 1. At this point, the nose 14 of the sinker remains forward so that the drawing down of the needle 18 with the lay-in yarn 12 carries the lay-in yarn over the top of the sinker nose 14. As best seen in FIG. 1, since every fourth needle 18 draws down the lay-in yarn 12 and since the noses 14 remain forward from point C until past point D, the drawing down of every fourth needle pulls the lay-in yarn over the noses of four adjacent sinkers 16. When the needles reach points C and D, they are below the knitting platform surfaces 44 (FIG. 3E) of the sinkers 16. Referring to FIG. 1, the horizontal broken line 46 illustrates the position of the knitting platform surfaces 44 of all of the sinkers 16 of the machine 10, which can be characterized as the lowest knitting platform of the machine 10.

As apparent from the foregoing, in accordance with the exemplary embodiment of the present invention, a pair of needles 18 pulls the lay-in yarn 12 down to a lower position that is at or below the lowest knitting platform, which is defined by the knitting platform surfaces 44, so that the section of the lay-in yarn that spans between the pair of needles simultaneously extends over noses 14 of multiple adjacent sinkers 16 (i.e., a group of intervening sinkers) that are positioned between the pair of needles and are maintained in a forward position sufficiently long so that robbing-back is at least partially counteracted. In other embodiments of the present invention, the pair of needles 18 pull the lay-in yarn 12 to other lower positions, such as, but not limited to, lower positions that are above, below, or even with the knitting platform surfaces 44 or other portions of the sinkers 16. Preferably the section of the lay-in yarn 12 that spans between the pair of needles 18 extends simultaneously over noses 14 of at least three adjacent intervening sinkers 16, and most preferably over four or at least four adjacent intervening sinkers, and in the embodiment of the present invention shown in the drawings, each intervening group of sinkers includes four sinkers. Alternatively, each intervening group of sinkers 16 may include more than four sinkers, or there may be only one intervening sinker positioned between each pair of needles 18 that pulls the lay-in yarn 12 down to the lower position, although typically there would be at least two intervening sinkers positioned between each pair of needles that pulls the lay-in yarn down to the lower position. Generally described with respect to each pair of needles 18 that pulls the lay-in yarn 12 down to the lower position, there are one or more intervening sinkers 16 that are positioned between the pair of needles and are arranged in a forward position so that a section of the lay-in yarn that spans between the pair of needles is temporarily retained over one or more nibs 14 of the one or more intervening sinkers.

In accordance with the exemplary embodiment, one or more intervening needles of the needles 18 are positioned between the pair of needles; and these intervening needle(s) are substantially maintained in a welt position and do not hold the lay-in yarn in the welt position. The intervening needle(s) 18 preferably may include five needles or more, four or at least four needles, three or at least three needles, two needles, or only one needle, and in the embodiment of the present invention shown in the drawings, each intervening group of needles includes three needles.

Because the lay-in yarn 12 spanning between the pair of needles 18 is contemporaneously pulled over the tops of one or more noses 14, an extra length of lay-in yarn is advantageously consumed so as to counteract the robbing back that normally occurs when lay-in yarn is carried by the needle hooks as the needles descend in the knitting machine. While some degree of robbing back still normally occurs in a knitting machine having the features of the present invention, the added length of the lay-in yarn exceeds the amount given up to robbing back. Thus, the amount and/or height of the floats 42 (a representative few of which are identified by their reference numeral in FIGS. 3D–E), which are floating portions of the lay-in yarn 12, is greater than otherwise would result.

The present invention advantageously allows for the manufacture of, and includes a method of manufacturing, a fleece fabric that can be, but is not required to be, formed on standard raceway knitting machines. In accordance with one aspect of the present invention, relatively large amounts of lay-in yarn are introduced into the fabric being formed, which results in the fabric being more easily brushed or napped for producing a denser and/or more lofty fleece. In accordance with one aspect of the present invention, only a single pass through a brushing or napping machine may be required to obtain the desired result. Sinkers with different height nibs or noses and/or nose lengths may be used to help determine the range of lay-in yarn amounts put into the fabric.

One feature of the present invention is advantageously embodied in a set of cam tracks for being used with/retrofitted to a conventional, standard raceway knitting machine, such that the set of cam tracks transform the conventional, standard raceway knitting machine into the above-described knitting machine 10.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A circular knitting machine for knitting a fabric with a lay-in yarn, the circular knitting machine comprising:

a cylinder having a central axis;

a plurality of needles arranged around the cylinder for reciprocating in the direction of the axis, with each needle having at least one butt;

a plurality of needle cam tracks arranged around the cylinder for respectively engaging the needle butts so that one or more intervening needles of the plurality of needles are positioned between at least a pair of the plurality of needles, wherein during a predetermined period:

the pair of needles engage and draw down the lay-in yarn and hold portions of the lay-in yarn in a lower position, and the one or more intervening needles do not draw down the lay-in yarn to the lower position; and a plurality of sinkers arranged around the axis at the upper portion of the cylindrical portion, for moving radially relative to the axis; and at least one sinker cam track arranged around the axis for selectively engaging and moving the sinkers so that during the predetermined period, there are one or more intervening sinkers of the plurality of sinkers that are positioned between the pair of needles and are arranged in a forward position so that a section of the lay-in yarn that spans between the pair of needles is temporarily retained over one or more nibs of the one or more intervening sinkers, whereby robbing back of the lay-in yarn is at least partially counteracted.

2. A circular knitting machine according to claim 1, wherein the one or more intervening sinkers include at least two sinkers and the one or more nibs include at least two nibs.

3. A circular knitting machine according to claim 1, wherein the one or more intervening needles include all of the needles positioned between the pair of needles.

4. A circular knitting machine according to claim 1, wherein the one or more intervening needles are substantially maintained in a welt position and do not hold the lay-in yarn in the welt position during the predetermined period.

5. A circular knitting machine according to claim 1, wherein the lower position, at which the portions of the lay-in yarn are held by the pair of needles, is below knitting platform surfaces of the plurality of sinkers.

6. A circular knitting machine according to claim 1, wherein the plurality of needle cam tracks includes:

a first needle cam track engaging the butts of the pair of needles for controlling the pair of needles, and a second needle cam track engaging the butts of the one or more intervening needles for controlling the one or more intervening needles.

7. A circular knitting machine according to claim 1, wherein the one or more intervening needles include at least three needles.

8. A circular knitting machine according to claim 1, each of the plurality of needles draws down a jersey yarn for knitting a knitted fabric.

9. A circular knitting machine according to claim 1, wherein at least some of the one or more intervening needles draw down a jersey yarn for knitting a knitted fabric.

10. A circular knitting machine according to claim 9, wherein:

the lower position, to which the lay-in yarn is drawn to by the pair of needles, is below knitting platform surfaces of the plurality of sinkers;

the plurality of needle cam tracks includes a first needle cam track engaging the butts of the pair of needles for controlling the pair of needles during the predetermined period, and a second needle cam track engaging the butts of the one or more intervening needles for controlling the one or more intervening needles during the predetermined period;

the one or more intervening needles include at least two needles; and the one or more intervening sinkers include at least three sinkers.

11. A set of cam tracks for at least partially counteracting robbing back of a lay-in yarn in a circular knitting machine that includes a plurality of needles and a plurality of sinkers, the set of cam tracks comprising:

a plurality of needle cam tracks for respectively engaging the needles so that one or more intervening needles of the plurality of needles are positioned between at least a pair of the plurality of needles, and so that during a predetermined period:

the pair of needles engage and draw down the lay-in yarn and hold portions of the lay-in yarn in a lower position, and the one or more intervening needles do not draw down the lay-in yarn to the lower position; and at least one sinker cam track for selectively engaging and moving the sinkers, so that during the predetermined period, there are one or more intervening sinkers of the plurality of sinkers that are positioned between the pair of needles and are arranged in a forward position, so that a section of the lay-in yarn that spans between the pair of needles is retained over one or more nibs of the one or more intervening sinkers.

12. A set of cam tracks according to claim 11, wherein the plurality of needle cam tracks includes:

a first needle cam track for engaging the butts of the pair of needles for controlling the pair of needles during the predetermined period, and a second needle cam track for engaging the butts of the one or more intervening needles for controlling the one or more intervening needles during the predetermined period, so that the one or more intervening needles do not engage the lay-in yarn during the predetermined period.

13. A set of cam tracks according to claim 11, wherein the plurality of needle cam tracks includes a plurality of cams that are capable of being removably mounted to the knitting machine, and the sinker cam track includes a plurality of cams that are capable of being removably mounted to the knitting machine.

14. A method of knitting a fleece fabric, comprising:

introducing a lay-in yarn and a jersey yarn into a circular knitting machine;

forming a base fabric structure from the jersey yarn by operating at least some of a plurality of needles and a plurality of sinkers of the machine; and causing portions of the lay-in yarn to extending above a face of the base fabric structure so as to define floating portions of the lay-in yarn, including:

operating at least a pair of the plurality of needles to engage, draw down, and hold portions of the lay-in yarn in a lower position during a predetermined period, operating one or more intervening needles of the plurality of needles such that the one or more intervening needles do not hold the lay-in yarn in the lower position during the predetermined period, with the one or more intervening needles being positioned between the pair of needles; and arranging one or more intervening sinkers of the sinkers in a forward position during the predetermined period, with the one or more intervening sinkers being positioned between the pair of needles, so that a section of the lay-in yarn that spans between the pair of needles is retained over one or more nibs of the one or more intervening sinkers, so as to at least partially counteract robbing back of the lay-in yarn.

15. A method according to claim 14, wherein the one or more intervening needles include all of the needles positioned between the pair of needles.

16. A method according to claim 14, wherein the arranging the one or more intervening sinkers includes arranging at least two of the sinkers that are positioned between the pair of needles in a forward position during the predetermined period, so that the section of the lay-in yarn that spans between the pair of needles is contemporaneously retained over at least two of the nibs of the one or more intervening sinkers, so as to substantially counteract robbing back of the lay-in yarn.

17. A method according to claim 14, wherein the operating the pair of the needles includes holding the portions of the lay-in yarn below knitting platform surfaces of the plurality of sinkers.

* * * * *